US010669087B2

(12) United States Patent
Paul

(10) Patent No.: US 10,669,087 B2
(45) Date of Patent: Jun. 2, 2020

(54) PALLET-LIKE UNDERSTRUCTURE FOR TRANSPORT AND STORAGE CONTAINERS FOR LIQUIDS

(71) Applicant: PROTECHNA S.A., Fribourg (CH)

(72) Inventor: Ulrich Paul, Ransbach-Baumbach (DE)

(73) Assignee: PROTECHNA S.A., Fribourg (CH)

( * ) Notice: Subject to any disclaimer, the term of this patent is extended or adjusted under 35 U.S.C. 154(b) by 317 days.

(21) Appl. No.: 15/544,337

(22) PCT Filed: Jan. 27, 2016

(86) PCT No.: PCT/EP2016/051653
§ 371 (c)(1),
(2) Date: Jul. 10, 2018

(87) PCT Pub. No.: WO2016/128215
PCT Pub. Date: Aug. 18, 2016

(65) Prior Publication Data

US 2019/0382177 A1 Dec. 19, 2019

(30) Foreign Application Priority Data

Feb. 11, 2015 (DE) ..... 20 2015 000 995 U

(51) Int. Cl.
*B65D 77/04* (2006.01)
*B65D 19/10* (2006.01)
(Continued)

(52) U.S. Cl.
CPC ..... *B65D 77/0466* (2013.01); *B65D 19/10* (2013.01); *B65D 19/18* (2013.01);
(Continued)

(58) Field of Classification Search
CPC .... B65D 19/00; B65D 19/0073; B65D 19/06; B65D 19/10; B65D 19/18; B65D 19/38;
(Continued)

(56) References Cited

U.S. PATENT DOCUMENTS 5,253,776 A 10/1993 Decroix
5,649,640 A 7/1997 Hermann
(Continued)

FOREIGN PATENT DOCUMENTS

CN 1053421 C 7/1991
CN 1029104 C 4/1995
(Continued)

*Primary Examiner* — Bryon P Gehman
(74) *Attorney, Agent, or Firm* — King & Schickli, PLLC

(57) ABSTRACT

A pallet-like understructure, in particular for transport and storage containers for liquids, which are equipped with an inner container made of plastic, with a closable filling neck and a draining neck for connecting a tapping armature, wherein the understructure has an outer jacket made of a metal grid or sheet metal, and a bottom (13) for supporting the inner container, corner feet and central feet arranged between the corner feet, as well as a bottom cross member (16), wherein at least the outer jacket and the bottom cross member are attached to at least two central feet, wherein the respective central foot, the outer jacket and the bottom cross member are coupled in a form-fitting fashion with the aid of a screw (45), wherein there is a bracket (28), which reaches around the bottom cross member (16) and around a peripheral edge of the outer jacket, wherein the screw (45) penetrates legs (29, 30) of the bracket.

15 Claims, 5 Drawing Sheets

(51) Int. Cl.
*B65D 19/18* (2006.01)
*B65D 19/38* (2006.01)

(52) U.S. Cl.
CPC .. *B65D 19/385* (2013.01); *B65D 2519/00024* (2013.01); *B65D 2519/00034* (2013.01); *B65D 2519/00164* (2013.01); *B65D 2519/00174* (2013.01); *B65D 2519/00273* (2013.01); *B65D 2519/00512* (2013.01); *B65D 2577/041* (2013.01)

(58) Field of Classification Search
CPC ..... B65D 19/385; B65D 21/02; B65D 25/14; B65D 77/04; B65D 77/0466; B65D 77/06; B65D 2519/00024; B65D 2519/00034; B65D 2519/00164; B65D 2519/00174; B65D 2519/00273; B65D 2519/00512; B65D 2577/041
USPC ..... 206/386, 599
See application file for complete search history.

(56) References Cited

U.S. PATENT DOCUMENTS

| | | | | |
|---|---|---|---|---|
| 8,505,721 | B2 * | 8/2013 | Schutz | B65D 77/0466 206/386 |
| 8,919,562 | B2 * | 12/2014 | Schutz | B65D 19/0073 206/599 |
| 9,233,777 | B2 * | 1/2016 | Weyrauch | B65D 19/385 |
| 9,394,077 | B2 * | 7/2016 | Weyrauch | B65D 19/06 |

FOREIGN PATENT DOCUMENTS

| | | | |
|---|---|---|---|
| CN | 102442460 | A | 5/2012 |
| CN | 102815440 | A | 12/2012 |
| EP | 0989071 | | 3/2000 |
| EP | 2418391 | | 2/2012 |
| EP | 2520504 | | 11/2012 |
| WO | WO2009120079 | A1 | 10/2009 |
| WO | WO2012085938 | | 6/2012 |

* cited by examiner

Fig. 2
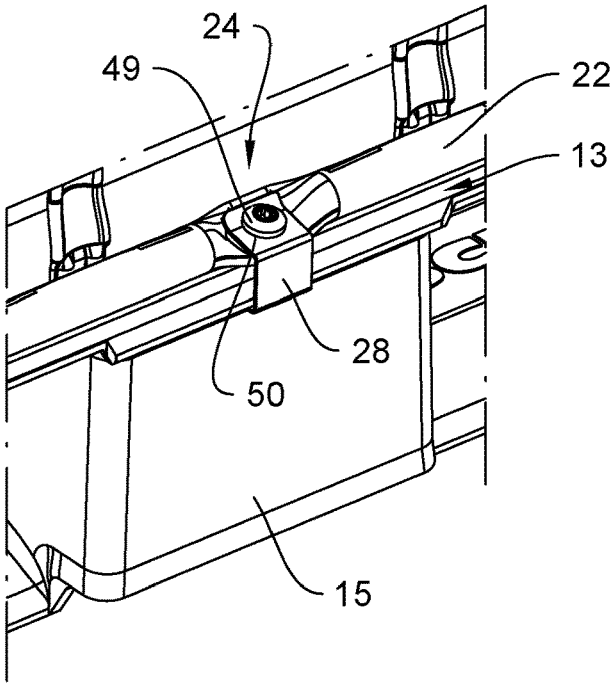
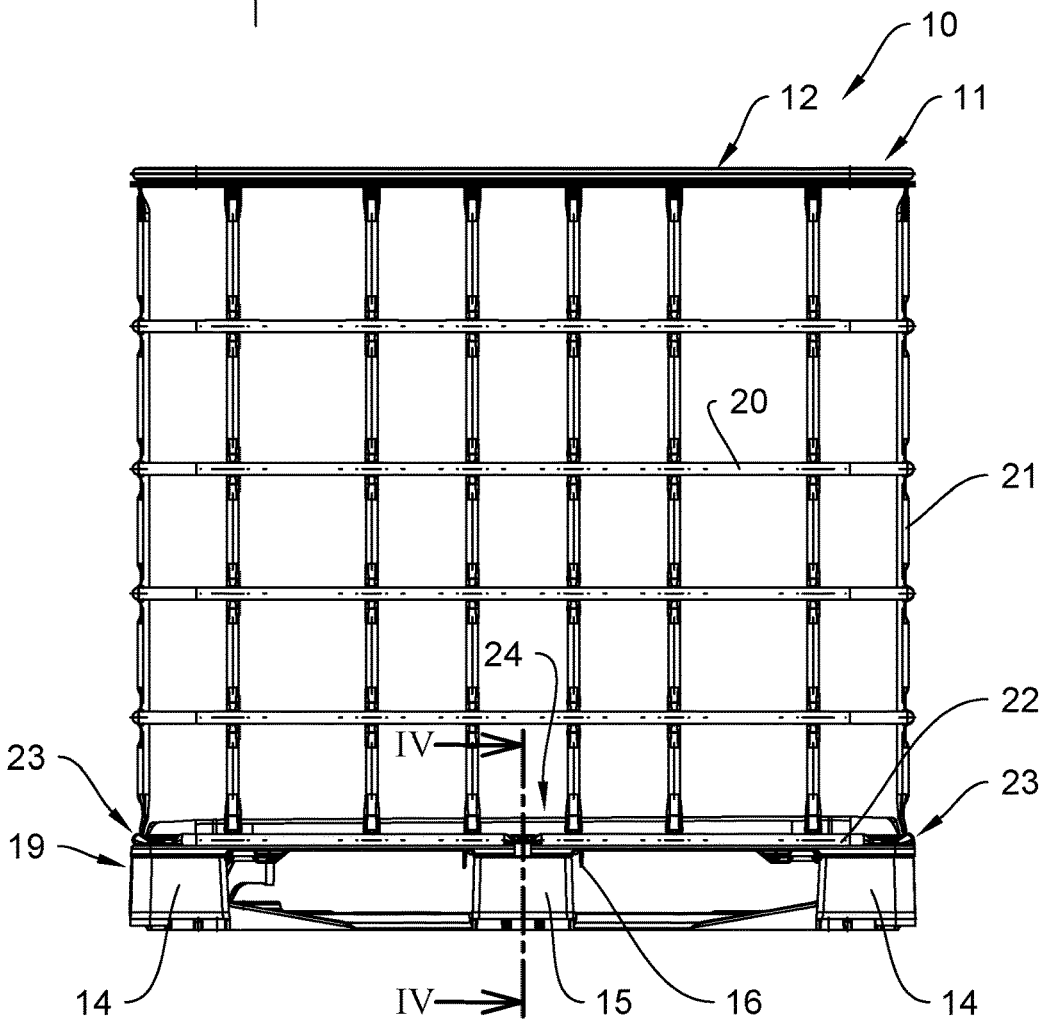
Fig. 3

PALLET-LIKE UNDERSTRUCTURE FOR TRANSPORT AND STORAGE CONTAINERS FOR LIQUIDS

FIELD OF THE INVENTION

The invention relates to a pallet-like understructure, in particular for transport and storage containers for liquids, which are equipped with an inner container made of plastic, with a closable filling neck and a draining neck for connecting a tapping armature, wherein the understructure has an outer jacket made of a metal grid or sheet metal, and a bottom for supporting the inner container, corner feet and central feet arranged between the corner feet as well as a bottom cross member, wherein at least the outer jacket and the bottom cross member are attached to at least two central feet, wherein the respective central foot, the outer jacket and the bottom cross member are coupled in a form-fitting fashion with the aid of a screw. In addition, the invention relates to a transport and storage container having such an understructure.

BACKGROUND OF THE INVENTION

Understructures of the afore-mentioned type form a platform that can be handled, for example, with the help of suitable stacker truck means, for storing and for transporting the inner containers realized from plastic. In this context, the outer jacket serves to protect inner container, which is comparatively fragile, from being damaged. The pallet-like understructure therefore is supposed to absorb, in particular, impact loads, which can act on the inner container, for example when the transport and storage container hits the floor. In particular when the transport and storage container strikes the floor or a ground at an angle, as a consequence of the mass inertia of a flowable substance present in the inner container, the inner container may be deformed or may also shift on the floor of the understructure. As a consequence, the outer jacket may be deformed in the region of the floor of the understructure in such a way that a protective sheath of the inner container formed by the outer jacket and by the floor of the understructure tears open in this region and that the inner container is damaged. Corresponding standardized drop tests are therefore envisaged for transport and storage containers envisaged for transporting hazardous materials, even though it is desirable to generally safeguard transport and storage containers from such damages.

SUMMARY OF THE INVENTION

In order to produce the understructures for transport and storage containers to be as stable as possible while the cost of materials is justifiable and the costs are low, it is known to screw the outer jacket directly to the feet while interleaving the bottom. In this context, the bottom and the feet of the understructure embody a pallet, wherein the feet may also be coupled to one another on a lower side by skids or by a frame. Since the bottom serves to support the inner container, a bottom cross member is habitually additionally disposed below the floor, said bottom cross member being arranged between two central feet and coupling the same to each other. The bottom cross member additionally serves to stabilize the understructure for the case of the transport and storage container hitting a ground along a along a foot frame side.

In the known transport and storage containers or understructures, the outer jacket or an underside of the outer jacket is coupled to the bottom, to the bottom cross member and to the central feet with the aid of screws. In order to design the understructure in a fashion as simple and cost-effective as possible, the screw is guided through sufficiently large clearance openings in the peripheral edge, in the bottom and in the bottom cross member and is only screwed into the central foot. When the transport and storage container hits the floor as described above along a foot frame side, as a consequence of a considerable tensile load on the screw, the screw may tear off or a screw thread of the screw may come off the central foot, whereupon the lower peripheral edge of the outer jacket is separated from the bottom of the understructure in such a fashion that the inner container may be deformed or damaged in this region. Here, a tensile force acting from the peripheral edge of the outer jacket on the screw directly acts on the coupling link of the screw and the central foot since the forces solely flow starting from the peripheral edge through the screw to the central foot. In particular when lightweight and cost-effective materials such as plastic or wood are supposed to be used for the central foot, screwing the screw and the central foot together has turned out to be a weak point in drop tests. Additionally, the screw may be positioned incorrectly upon mounting or may be "overtightened". Depending on the storage location, high temperatures may also weaken a screw coupling including, for example, plastic.

It is essential in such an attachment configuration that, for facilitating a relative positioning of the component parts upon mounting, sufficiently large clearance openings are disposed in the peripheral edge, in the bottom and in the bottom cross member, such that the same can easily be aligned with one another and that the screw can easily be introduced through the clearance opening and be screwed to the central foot. In particular, it is also advantageous if the clearance openings are dimensioned such amply that a comparatively large play is realized between the component parts mentioned above and the screw.

The present invention is therefore based on the task of proposing a pallet-like understructure for a transport and storage container for liquids as well as a transport and storage container having an understructure, guaranteeing an increased safety and still being producible in a simple and cost-effective fashion.

In the understructure in accordance with the invention, in particular for transport and storage containers for liquids, which are equipped with an inner container made of plastic, with a closable filling neck and a draining neck for connecting a tapping armature, the understructure has an outer jacket made of a metal grid or sheet metal, and a bottom for supporting the inner container, corner feet and central feet arranged between the corner feet as well as a bottom cross member, wherein at least the outer jacket and the bottom cross member are attached to at least two central feet, wherein at least the respective central foot, the outer jacket and the bottom cross member are coupled together in a form-fitting fashion in an attachment configuration with the aid of a screw, wherein there is a bracket, which reaches around the bottom cross member and around a peripheral edge of the outer jacket, wherein the screw penetrates legs of the bracket.

Due to the fact that the bracket reaches around the peripheral edge of the outer jacket and around the bottom cross member, a tensile force effected from the peripheral edge onto the screw may at least partially be transferred to the bracket and transmitted into the bottom cross member. A screw coupling of the screw and the central foot can therefore be relieved advantageously. A risk of the screw breaking or tearing off or of the screw coming off the central foot can thus be effectively reduced by using and arranging the bracket. In addition, the costs for a bracket and the mounting thereof at the understructure are very low on grounds of the simple implementation and handling. Depending on the implementation of the understructure, the same may have a bracket at each one of multiple attachment points.

Advantageously, the bracket may be embodied so as to U-shaped or V-shaped and may have two opposing legs. The bracket may then be a U-shaped or V-shaped bent sheet metal strip. The bracket may be adapted to a shape of the peripheral edge, of the bottom cross member or of the screw. For example, the bracket may also be embodied such that the bracket catches with the bottom cross member and/or with the peripheral edge upon mounting of the bracket.

Consequently, an upper leg may be arranged above the peripheral edge and a lower leg may be arranged between the central foot and the bottom cross member. If a gap is realized between the central foot and the bottom cross member, the lower leg may simply be slid into the gap between the central foot and the bottom cross member. It may also be envisaged that a flanging is realized at the upper leg or that an end of the upper leg is embodied so as to be angled from the upper leg, in such a manner that a surface in the manner of a guide for centering the bracket is realized at the upper leg upon mounting of said bracket. Mounting the bracket is thereby simplified substantially.

The bracket may have a clearance opening in at least the upper leg. Then, the screw may easily be inserted into the upper leg or into the clearance opening realized therein upon mounting. If the screw is, for example, a self-cutting tapping screw or another suitable screw, realizing a clearance opening in the lower leg can be spared since the screw can then simply be screwed into the lower leg. Nonetheless, it is possible to already dispose a clearance opening for the screw in the lower leg.

A screw thread may also be embodied in the lower leg, the screw engaging with said screw thread, wherein the screw thread may then be realized with the aid of the screw. For example, a clearance opening in the manner of a borehole or of an elongated hole may be disposed in the lower leg, into which the screw may be screwed. In this context, it may be envisaged that an inside diameter of the clearance opening is smaller than an outside diameter of the screw, such that the screw realizes the screw thread in the lower leg upon being screwed in. Here, mounting of the screw is simplified, too, since the same may easily be aligned in the lower leg in an envisaged mounting position with the aid of the clearance opening.

It is particularly advantageous if the clearance opening is embodied in the lower leg with a hollow. A hollow or a cavity or bead allows for easier introduction of the screw into the clearance opening in such a manner that the screw is guided towards the clearance opening. In addition, the region of the clearance opening or screwed joint with the lower leg may be stabilized through the hollow or cone-shaped hollow, such that it is made difficult that the screw comes off the lower leg. The hollow may have an opening angle of 90°.

A nose may be embodied at the lower leg, wherein the nose may engage with a clearance opening of the bottom cross member. The bracket or the lower leg may then be slid into a gap between the bottom cross member and the central foot upon mounting, wherein the nose may then catch in the clearance opening of the bottom cross member. In this way, the bracket then cannot be removed anymore without effort. Additionally, the bracket then already is secured in a position envisaged for mounting. If a clearance opening is embodied at the lower leg of the bracket, the nose may directly be realized at an edge of the clearance opening. In addition, it may be envisaged that the nose has a wedge-shaped slope, which facilitates sliding the lower leg into the gap between the bottom cross member and the central foot.

Therefore, the screw may be coupled to the bottom cross member in such a fixed manner that a flow of forces, as a consequence of a tensile force acting on the outer jacket, may be transmitted into the screw and/or the bracket from the outer jacket and be transferred to the bottom cross member through the screw and/or the bracket. The screw may thus directly be fixedly coupled to the bottom cross member. In addition, the screw is fixedly coupled to the respective central foot, such that a tensile force effected by the outer jacket, for example as a consequence of a crash of the transport and storage container, within the screw and the bracket can be transferred into the bottom cross member and the central foot. A screw coupling of the screw and of the central foot is stressed less in this way, which leads to an increased stability or safety of the understructure, without further component parts having to be used except the bracket. There is no risk of corrosion when screwing the screw and the bottom cross member together since the screw is then fixedly coupled or screwed to the bottom cross member, such that an anti-corrosion coating of a surface cannot be destroyed and there cannot be any abrasion due to a relative movement of the structural elements.

In a preferred embodiment, the central foot, the outer jacket, the bottom, the bottom cross member and the bracket may be coupled in a form-fitting fashion with the aid of the screw. The attachment configuration realized in this way then also comprises the bottom of the understructure, which does not necessarily have to be coupled to the same in the region of the central feet. In addition, the screw may then reach through clearance openings embodied in each instance in the outer jacket, in the bottom and in the bracket. The clearance openings may preferably be embodied such that a sufficiently large play remains between inner rims of the clearance openings and the screw. The clearance openings in the outer jacket may then be embodied in the peripheral edge of the outer jacket. If the outer jacket is for example realized from interlaced, horizontal and vertical grid bars made of metal, the clearance openings may in each instance be embodied in a lower horizontal pipe, which then realizes the peripheral edge.

The bracket and the bottom cross member may preferably be realized from metal, wherein the bottom may be realized from metal or from plastic material. It may also be envisaged to realize the bottom cross member in one piece, for example as a profiled element or as a structural element produced by forming metal sheets. The bottom may likewise be produced in a particularly cost-effective and stable fashion from a deep-drawn metal sheet or alternatively from a plastic material.

The screw coupling of the screw and the bottom cross member can particularly simply be realized if a clearance opening for engaging with the screw is embodied in the bottom cross member. In this way, it can then also be ensured that the screw, upon mounting of the understructure, is always screwed into the bottom cross member at the place envisaged therefor at said bottom cross member. In addition, an inside diameter of the clearance opening may be smaller than an outside diameter of the screw. In this way, it can then also be ensured that a screw thread of the screw actually comes into engagement with the material of the bottom cross member in the region of the clearance opening.

A tensile force can thus, as already stated previously, not be completely transmitted by the screw alone into the central foot, but be received by the bottom cross member via the bracket for a considerable part. The screw having been screwed into the central foot or the screw coupling realized in this way is then also stressed less, such that, in particular in the context of central feet made of plastic material or wood, it can be avoided that the screw comes off the central foot.

In order to realize the understructure to be even safer and more stable, the bottom cross member may be coupled to the central foot in a form-fitting fashion with the help of a further screw. Accordingly, the further screw may be screwed into the central foot and engage with a screw thread in the central foot with a bolt thread. The tensile force transmitted into the bottom cross member via the bracket, amongst other things, may then be transmitted onto the central foot via the screw. Realizing this further attachment configuration consisting of the bottom cross member, the further screw and the central foot may advantageously prevent the central foot from being torn off the bottom cross member as a consequence of a crash of the transport and storage container. In this way, any transverse forces acting on the central foot may also transmitted into the bottom cross member via the further screw.

It has turned out to be particularly advantageous if the central feet are realized from a plastic material. Such central feet are particularly stable, immune to humidity and can be produced in a cost-effective fashion. Alternatively, the central feet may also be realized from metal, wood or another suitable material.

A screw thread may be embodied in the central foot, with which the screw engages. In this context, an internal screw thread in the central foot can be cut or molded by the screw itself. The central foot may also be embodied such that it already has a screw thread. Preferably, a molding, for example a depression or a borehole, may be embodied in the central foot in order to guarantee a secure guiding and positioning of the screw upon mounting.

The understructure may have two central feet facing each other, which are coupled to each other via the bottom cross member. In this way, the bottom of the understructure may be supported or stabilized particularly simply with the aid of the bottom cross member. The bottom cross member may also couple three central feet to one another, wherein the third central foot can then be attached to the bottom cross member in the middle between the two outer central feet. Alternatively, it is also possible to couple, with the aid of the bottom cross member, two central feet arranged at orthogonal lateral rims of the bottom relative to each other in relation to the bottom, such that the bottom cross member runs diagonally below the bottom.

In the transport and storage container for liquids in accordance with the invention, which is equipped with an inner container made of plastic, with a closable filling neck and a draining neck for connecting a tapping armature, the inner container is arranged on a bottom of a pallet-like understructure according to one or more of the claims 1 to 15.

BRIEF DESCRIPTION OF THE DRAWING FIGURES

Preferred embodiments will be explained in more detail below using the drawings. In the figures:

FIG. 2 shows a detailed view of a central foot of the understructure from FIG. 1;

FIG. 3 shows a side view of the understructure from FIG. 1;

DETAILED DESCRIPTION OF THE INVENTION

Figure 1:
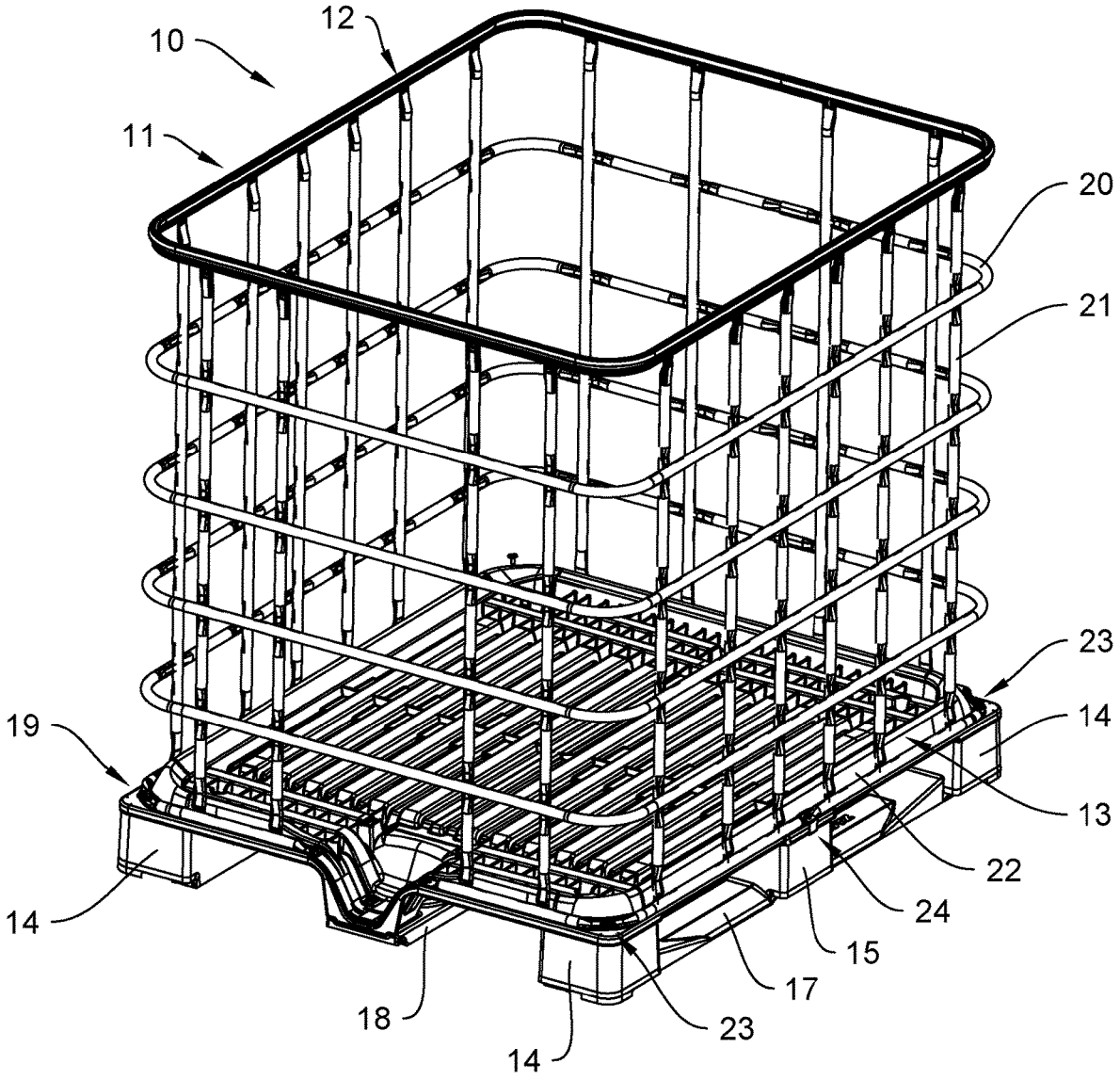
FIG. 1 shows a pallet-like understructure according to a first embodiment in a perspective view.

FIGS. 1 to 5 show a first embodiment of a transport and storage container 10 in different views, wherein in particular an inner container of the transport and storage container 10 is not depicted in more detail here, such that only an understructure 11 of the transport and storage container 10 is illustrated. The understructure 11 is substantially realized from an outer jacket 12, a bottom 13 as well as corner feet 14 and central feet 15 arranged between the corner feet 14 and from a bottom cross member 16 situated between the central feet 15. In detail, the corner feet 14 and the central feet 15 are arranged on skids 17 or 18. The bottom 13, the corner feet 14, the central feet 15, the bottom cross member 16 as well as the skids 17, 18 together realize a pallet 19. The outer jacket 12 arranged on the pallet 19 is realized from interlaced, horizontal and vertical grid bars 20, 21 made of metal, wherein in particular a lower grid bar 20 resting on the pallet 19, of the outer jacket 12, is embodied as a pipe 22, which is coupled to the corner feet 14 via attachment points 23 and to the central feet 15 via attachment points 24.

Figure 4:
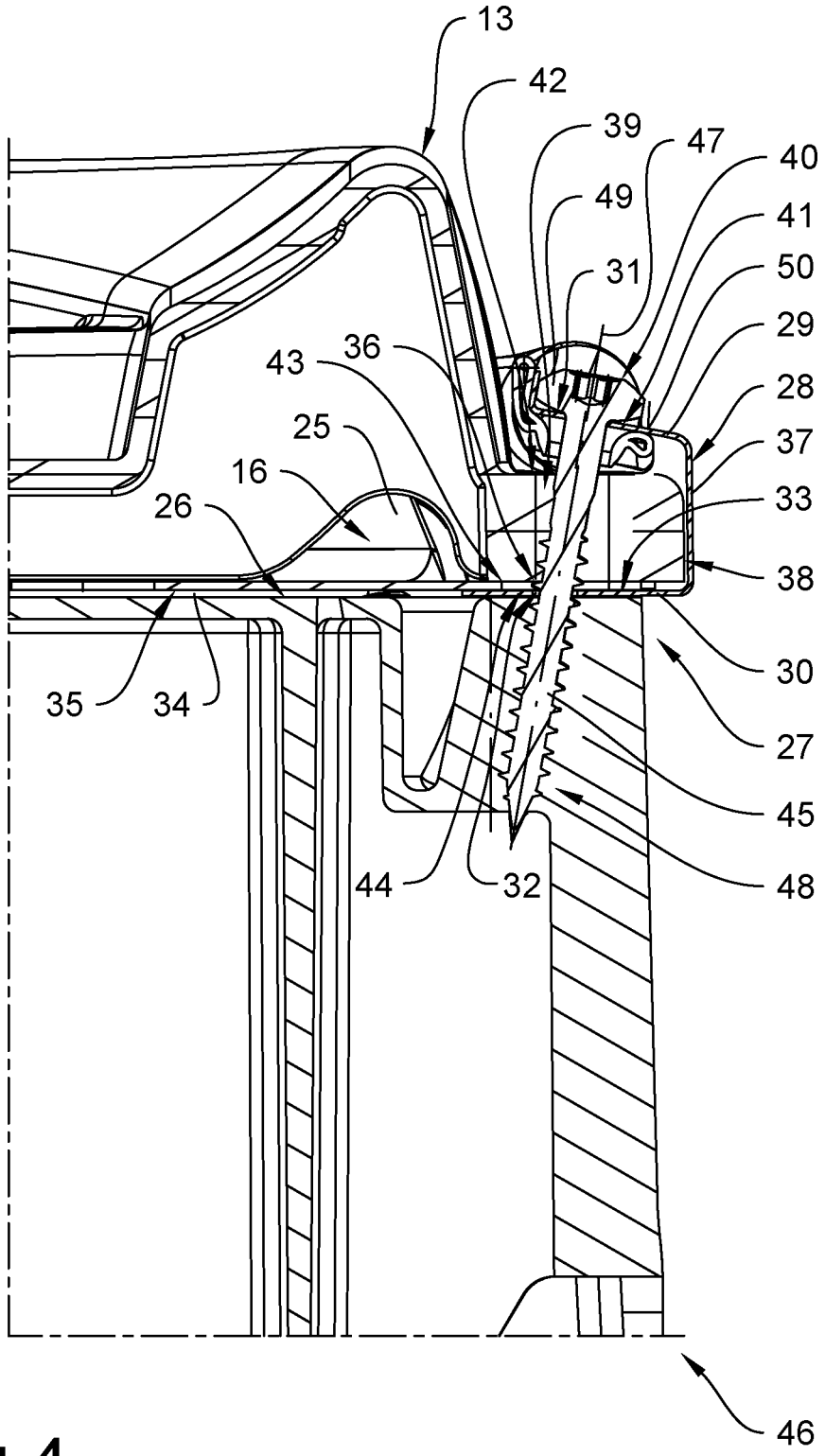
FIG. 4 shows a sectional view along a line IV-IV from FIG. 3.
Figure 5:
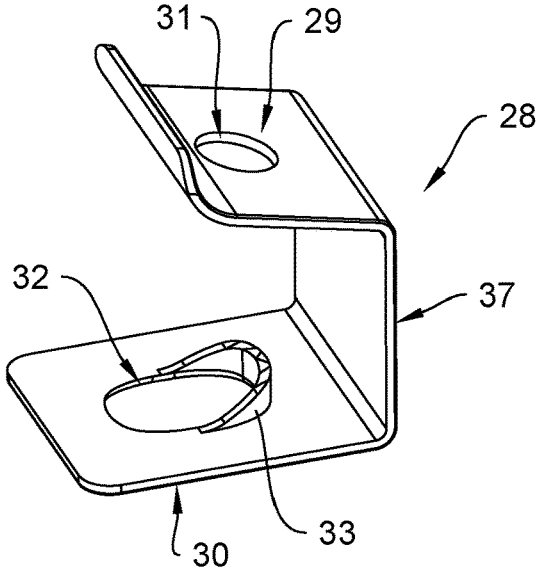
FIG. 5 shows a perspective view of a bracket according to a first embodiment.

A combined view of FIGS. 2 and 4 shows an attachment point 24 with a central foot 15, wherein the outer jacket 12 or the pipe 22 is not illustrated in the sectional view illustrated in FIG. 4. The bottom cross member 16 is formed from a profiled body 25 made of metal, and is arranged on an upper side 26 of the central foot 15. In addition, the bottom 13 has been placed onto the bottom cross member 16 or on the profiled body 25 above the bottom cross member 16 in an edge region 27 of the central foot 15. A bracket 28 is likewise arranged in the edge region 27, wherein the bracket 28 has an upper leg 29 and a lower leg 30. In the upper leg 29, a clearance opening 31 is realized and in the lower leg 30, a clearance opening 32 is realized. In the region of the clearance opening 32, a nose 33 is in addition realized at the lower leg 30. The lower leg 30 has been slid into a gap 34 between the upper side 26 of the central foot 15 and a lower side 35 of the profiled body 25, wherein the nose 33 engages with a clearance opening 36 of the profiled body 25. In this context, a land 37 of the bracket 28 coupling the legs 29 and 30 rests against an outer rim 38 of the bottom 13. The upper leg 29 reaches over the pipe 22 not illustrated in FIG. 4, of the outer jacket 12. In addition, a clearance opening 39 is likewise disposed in the bottom 13, wherein a screw 40 has been screwed into the central foot 15 through the clearance opening 31, 39, 32 and 36. In this context, the inside diameters 41 to 44 of the clearance opening 31, 32, 36 or 39 are dimensioned to be so large that a sufficiently large play relative to an outside diameter 45 of the screw 40 is realized, which prevents a touch with the screw 40 in the region of the inside diameters 41 to 44. The same is true for the clearance opening 36 not illustrated in a detailed fashion here, in the profiled body 25.

An impact force now effected as a consequence of a crash of the transport and storage container 10 onto an outer rim 46 of the central foot 15 again leads to a deformation or shift of the inner container not illustrated here within the outer jacket 12, such that the outer jacket 12 for its part exerts a tensile force in the direction of a longitudinal axis 47 of the screw 40 onto the same. In this context, the tensile force directly acts on a screw coupling 48 of the screw 40 with the central foot 15. Since the pipe 22 is arranged between a screw head 49 or below the lower leg 29 and the central foot 15, the tensile force emanating from the pipe 22 acts on the bracket 28, such that a part of the tensile force can be transferred via the bracket 28 since the bracket 28 reaches under the profiled body 25 with the lower leg 30. The tensile force acting on the screw coupling 48 is consequently reduced by the tensile force transferred via the bracket 28, which reduces the risk of the screw 40 coming off the central foot 15. The tensile force transferred via the bracket 28 can also be transmitted into the profiled body 25 via the nose 33 at the lower leg 30 of the bracket 28. Moreover, the upper leg 29 serves as a bearing face 50 for the screw head 49, such that the use of a washer might be spared here.

Figure 6:
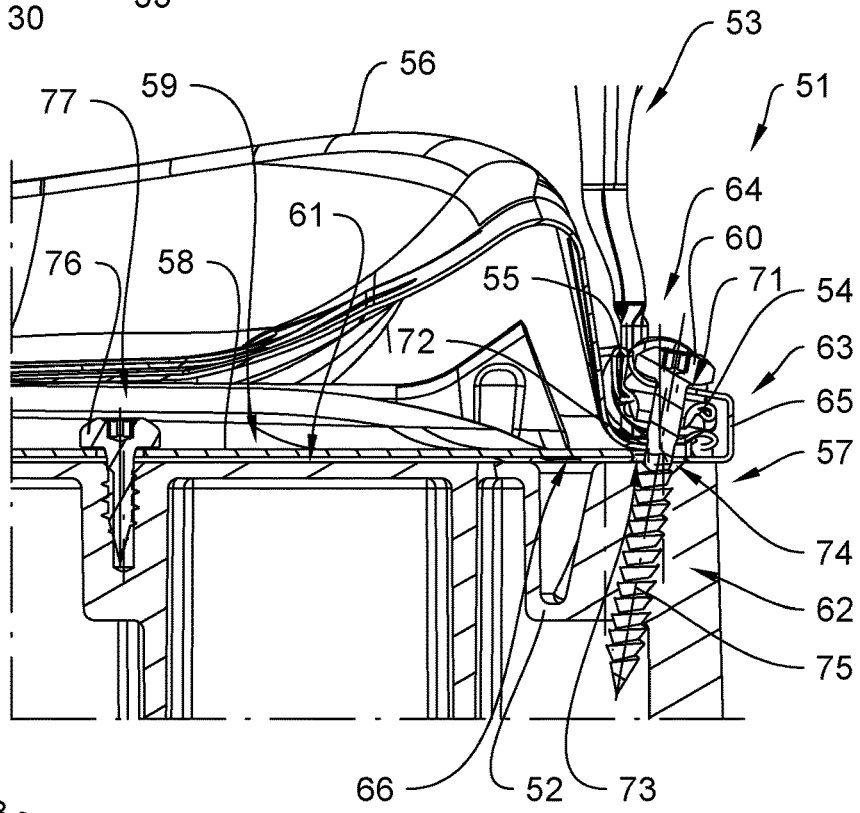
FIG. 6 shows a sectional view of an understructure according to a second embodiment.
Figure 7:
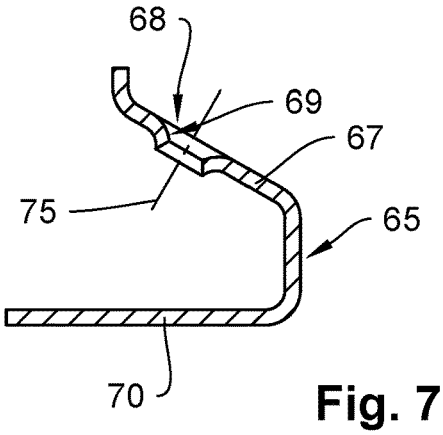
FIG. 7 shows a sectional view of a bracket according to a second embodiment.
Figure 8:
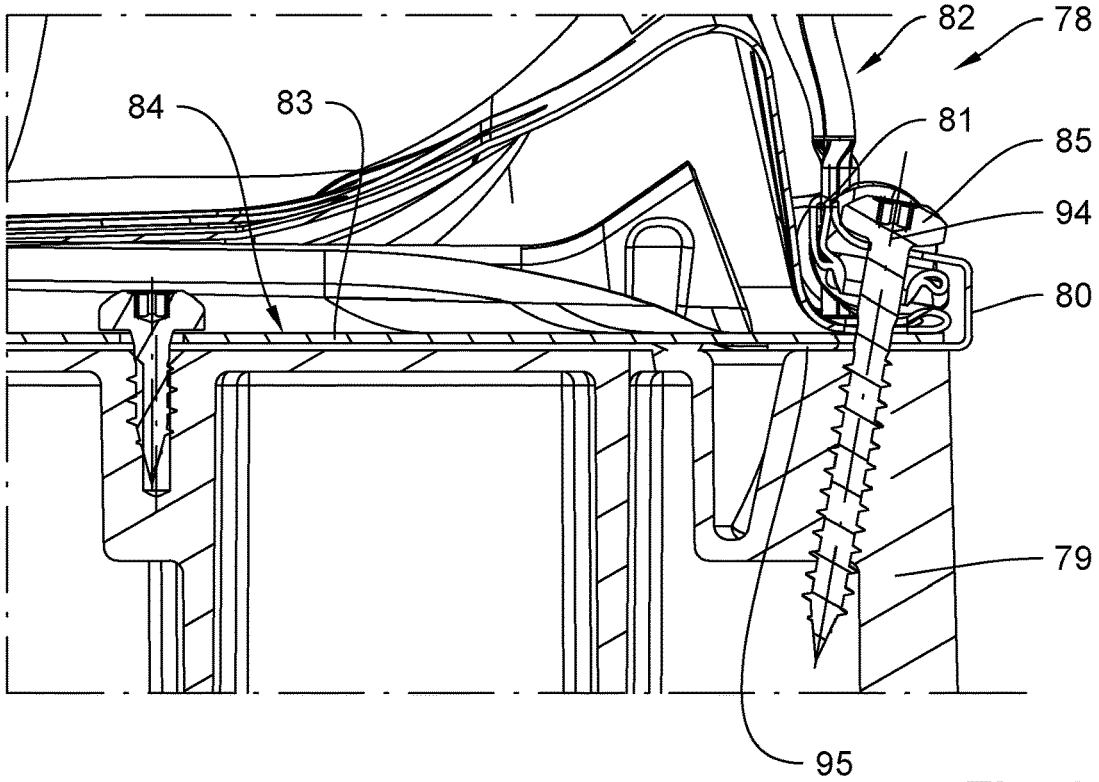
FIG. 8 shows a sectional view of an understructure according to a third embodiment.
Figure 9:
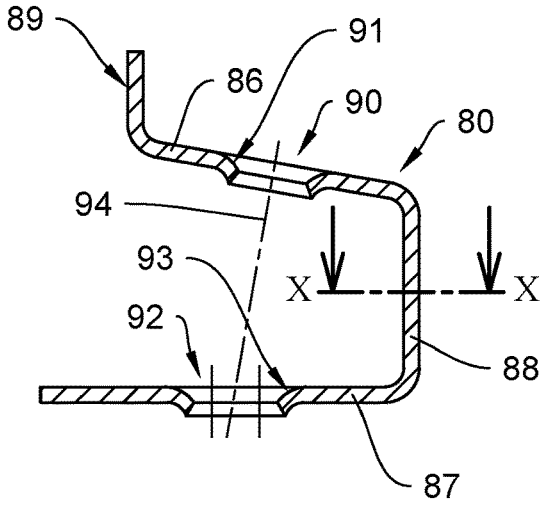
FIG. 9 shows a sectional view of a bracket according to a third embodiment.
Figure 10:
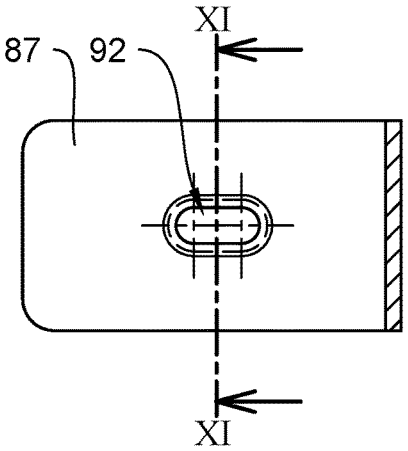
FIG. 10 shows a sectional view along a line X-X from FIG. 9.
Figure 11:
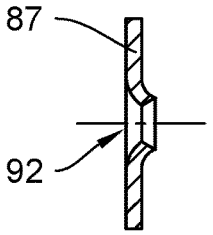
FIG. 11 shows a sectional view along a line XI-XI from FIG. 10.

A combined view of FIGS. 6 and 7 shows a sectional view of an understructure 51 of a transport and storage container not illustrated in more detail here, in the region of a central foot 52. The fundamental construction of the transport and storage container and of the understructure 51 corresponds to the transport and storage container shown in FIGS. 1 to 5, apart from the differences described below. An outer jacket 53 of the understructure 51 rests on a circumferential bearing face 55 of a bottom 56 of the understructure 51 with a pipe 54. The bottom 56 for its part rests on an edge region 57 of the central foot 52 together with a one-piece profiled body 58, which embodies a bottom cross member 59. The bottom cross member 59 or the profiled body 58 couples the central foot 52 to an opposing central foot not illustrated in more detail here. In addition, a screw 60 is envisaged, which has been driven into an upper side 61 of the central foot 52 made of plastic material, in this way realizing a screw coupling 62. The screw 60 thus couples the outer jacket 53 to the bottom 56, the profiled body 58 or to the bottom cross member 59 and the central foot via pipe 54, whereby an attachment configuration 63 is realized in an attachment point 64 at the central foot 52.

In addition, in the frame of the attachment configuration 63, a bracket 65 is envisaged, which reaches around the bottom cross member 59 or around the profiled body 58 at a lower side 66 and around the outer jacket 53 or the pipe 54. In an upper leg 67, a clearance opening 68 having a hollow 69 is realized, wherein a lower leg 70, in an unmounted state of the bracket 65, initially does not have any clearance opening whatsoever. The screw 60 has been guided through the clearance opening 68 in the bracket 65, through a clearance opening 71 in the pipe 54, a clearance opening 72 in the bottom 56, a clearance opening 73 in the profiled body 58 and a clearance opening 74, in the lower leg 70 of the bracket 65, realized upon driving in the screw 60. A tensile force effected by the loading case described above, of a crash of the transport and storage container, acting in the direction of a longitudinal axis 75 of the screw 60, is consequently transmitted into the central foot 53 via the screw 60 in this way, wherein a part of the tensile force is equally transmitted into the profiled body 58 or the bottom cross member 59 via the bracket 65, as a consequence of the form-fitting arrangement of the bracket or of the lower leg 70 below the profiled body 58, into the same. The screw coupling 62 with the central foot 52 is thus relieved by the amount of this part of the tensile force.

Complementarily, a second screw 76 is envisaged, with the aid of which the profiled body 58 is coupled to the central foot 52 by screwing them together. The screw 76, the profiled body 58 and the central foot 52 thus realize a further attachment configuration 77, which serves to safely arrange the central foot 52 at the profiled body 58.

A combined view of FIGS. 8 to 11 shows a sectional view of an understructure 78 of a transport and storage container not illustrated in more detail, in the region of a central foot 79. The construction of the transport and storage container and of the understructure 78 corresponds to the construction of the transport and storage container shown in FIGS. 6 to 7, apart from the differences described below. A bracket 80 reaches around a pipe 81 of an outer jacket 82, around a bottom 95 as well as around a profiled body 83 of a bottom cross member 84. A screw 85 penetrates the bracket 80, the pipe 81, the bottom 95, and the profiled body 83 and has been screwed into the central foot 79. The bracket 80 has an upper leg 86 and a lower leg 87, which are coupled via a land 88. One end 89 of the upper leg 86 is embodied so as to be angled, such that the bracket 80 can easily be slid onto the pipe 81. In addition, a clearance opening 90 having a hollow 91 for guiding the screw 85 is realized in the upper leg 86. A clearance opening 92 in the shape of an elongated hole having a hollow 93 like this is realized in the lower leg 87. The clearance opening 92 in the shape of an elongated hole allows for selectively arranging the screw 85 in the frame of the clearance opening 92 in such a manner that a longitudinal axis 94 of the screw 85 penetrates both clearance openings 90, 92. Clearance opening 92 is embodied such that the screw 85 deforms the clearance opening 92 upon being screwed into the same.

The invention claimed is:

1. A pallet understructure (11, 51, 78) for transport and storage containers for liquids, which are equipped with an inner container made of plastic, with a closable filling neck and a draining neck for connecting a tapping armature, wherein the understructure has an outer jacket (12, 53, 82) made of a metal grid or sheet metal, and a bottom (13, 56, 95) for supporting the inner container, corner feet and central feet (15, 52, 79) arranged between the corner feet as well as a bottom cross member (16, 59, 84), wherein at least the outer jacket and the bottom cross member are attached to the central feet, wherein the central feet (15, 52, 79), the outer jacket and the bottom cross member are coupled in a form-fitting fashion with the aid of a screw (45, 60, 85), characterized in that there is a bracket (28, 65, 80), which reaches around the bottom cross member (16, 59, 84) and around a peripheral edge of the outer jacket (12, 53, 82), wherein the screw (45, 60, 85) penetrates legs (29, 30, 67, 70, 86, 87) of the bracket;

wherein an upper leg (29, 67, 86) is arranged above the peripheral edge and a lower leg (30, 70, 87) is arranged between the central foot (15, 52, 79) and the bottom cross member (16, 59, 84).

2. The understructure according to claim 1, characterized in that the bracket (28, 65, 80) is embodied so as to be U-shaped or V-shaped and has two opposing legs (29, 30, 67, 70, 86, 87).

3. The understructure according to claim 1, characterized in that the bracket (28, 65, 80) has a clearance opening (31, 68, 90) in at least the upper leg (29, 67, 86).

4. The understructure according to claim 3, characterized in that a screw thread is embodied in the lower leg (30, 70, 87), the screw (45, 60, 85) engaging with said screw thread, wherein the screw thread is realized with the aid of the screw.

5. The understructure according to claim 3, characterized in that the clearance opening (31, 32, 68, 74, 90, 92) is embodied in the leg (29, 30, 67, 70, 86, 87) with a hollow (69, 91, 93).

6. The understructure according to claim 1, characterized in that a nose (33) is embodied at the lower leg (30), wherein the nose engages with a clearance opening (36) of the bottom cross member (16, 59, 84).

7. The understructure according to claim 1, characterized in that the screw (45, 60, 85) is engaged with the bottom cross member (16, 59, 84) in a form-fitting fashion, in such a manner that a tensile force realized between the bottom cross member and the outer jacket (12, 53, 82) can be transmitted via at least one of the screw and the bracket (28, 65, 82).

8. The understructure according to claim 7, characterized in that the central foot (15, 52, 79), the outer jacket (12, 53, 82), the bottom (13, 56, 95), the bottom cross member (16, 59, 84) and the bracket (28, 65, 80) are coupled in a form-fitting fashion with the aid of the screw (45,60, 85), wherein the screw reaches through clearance openings (31, 32, 36, 39, 68, 71, 72, 73, 74, 90, 92) embodied in each instance in the outer jacket, in the bottom and in the bracket.

9. The understructure according to claim 1, characterized in that the bracket (28, 65, 80) and the bottom cross member (16, 59, 84) are realized from metal, and in that the bottom (13, 56, 95) is realized from metal or from plastic material.

10. The understructure according to claim 1, characterized in that a clearance opening (36, 73) for engaging with the screw (45, 60, 85) is embodied in the bottom cross member (16, 59, 84), wherein an inside diameter of the clearance opening is smaller than an outside diameter (45) of the screw.

11. The understructure according to claim 1, characterized in that the bottom cross member (16, 59, 84) is coupled to the central foot (15, 52, 79) in a form-fitting fashion with the aid of a further screw (76).

12. The understructure according to claim 1, characterized in that the central feet (15, 52, 79) are realized from a plastic material.

13. The understructure according to claim 1, characterized in that a screw thread is embodied in the central foot (15, 52, 79), with which the screw (45, 60, 85) engages.

14. The understructure according to claim 1, characterized in that two central feet (15, 52, 79) facing each other are coupled to each other via the bottom cross member (16, 59, 84).

15. A transport and storage container for liquids, which is equipped with an inner container made of plastic, with a closable filling neck and a draining neck for connecting a tapping armature, wherein the inner container is arranged on a bottom of a pallet understructure (11, 51, 78) according to claim 1.

* * * * *